US009464819B2

(12) United States Patent
Enohara et al.

(10) Patent No.: US 9,464,819 B2
(45) Date of Patent: Oct. 11, 2016

(54) AIR CONDITIONING CONTROL SYSTEM AND AIR CONDITIONING CONTROL METHOD

(75) Inventors: Takaaki Enohara, Hino (JP); Kenji Baba, Kodaira (JP); Kazumi Nagata, Fuchu (JP); Shuhei Noda, Fuchu (JP); Nobutaka Nishimura, Koganei (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 668 days.

(21) Appl. No.: 12/874,309

(22) Filed: Sep. 2, 2010

(65) Prior Publication Data

US 2011/0205366 A1 Aug. 25, 2011

(30) Foreign Application Priority Data

Feb. 24, 2010 (JP) ..... 2010-039157

(51) Int. Cl.
*H04N 7/18* (2006.01)
*H04N 9/47* (2006.01)
*F24F 11/00* (2006.01)

(52) U.S. Cl.
CPC .... *F24F 11/0034* (2013.01); *F24F 2011/0036* (2013.01)

(58) Field of Classification Search
USPC ..... 348/61–159
See application file for complete search history.

(56) References Cited

U.S. PATENT DOCUMENTS 4,873,649 A * 10/1989 Grald et al. ..... 700/276
5,170,935 A * 12/1992 Federspiel et al. ..... 236/44 C (Continued)

FOREIGN PATENT DOCUMENTS

CN 1079815 A 12/1993
CN 1425683 A 6/2003

(Continued)

OTHER PUBLICATIONS

Notification of Reasons for Rejection issued by the Japanese Patent Office on Jan. 10, 2012, for Japanese Patent Application No. 2010-039157, and English-language translation thereof.

(Continued)

*Primary Examiner* — Frederick Bailey
*Assistant Examiner* — Talha M Nawaz
(74) *Attorney, Agent, or Firm* — Finnegan, Henderson, Farabrow, Garrett & Dunner LLP

(57) ABSTRACT

According to one embodiment, an air conditioning control system is connected to a camera device, which is installed in an interior as an inside of a room and an air conditioning control target, and to an air conditioner that performs air conditioning for the interior as the air conditioning target, the air conditioning control system includes: an activity amount calculation unit; a current comfort index value calculation unit; a control parameter calculation unit; and an air conditioner control unit. The activity amount calculation unit acquires and analyzes image information formed by imaging the interior as the air conditioning control target from the camera device, and calculates an activity amount of a person present in the room based on the image information. The current comfort index value calculation unit calculates a current comfort index value of the person present in the room based on the activity amount. The control parameter calculation unit calculates a control parameter regarding an operation of the air conditioner based on the current comfort index value. The air conditioner control unit controls the operation of the air conditioner based on the control parameter.

8 Claims, 6 Drawing Sheets

(56) References Cited

U.S. PATENT DOCUMENTS

| | | | | |
|---|---|---|---|---|
| 5,621,662 | A * | 4/1997 | Humphries et al. | 700/276 |
| 6,912,429 | B1 * | 6/2005 | Bilger | 700/19 |
| 7,047,092 | B2 * | 5/2006 | Wimsatt | 700/83 |
| 2003/0096572 | A1 | 5/2003 | Gutta et al. | |
| 2003/0227439 | A1 * | 12/2003 | Lee et al. | 345/156 |
| 2004/0041910 | A1 * | 3/2004 | Naidoo et al. | 348/156 |
| 2007/0240437 | A1 * | 10/2007 | Yonezawa et al. | 62/176.1 |
| 2008/0212839 | A1 * | 9/2008 | Salla et al. | 382/107 |
| 2010/0063862 | A1 * | 3/2010 | Thompson et al. | 705/10 |
| 2010/0262296 | A1 * | 10/2010 | Davis et al. | 700/275 |
| 2010/0262297 | A1 * | 10/2010 | Shloush et al. | 700/276 |
| 2010/0289643 | A1 * | 11/2010 | Trundle et al. | 340/545.1 |
| 2011/0102588 | A1 * | 5/2011 | Trundle et al. | 348/143 |
| 2011/0190594 | A1 * | 8/2011 | Heit et al. | 600/301 |

FOREIGN PATENT DOCUMENTS

| | | |
|---|---|---|
| CN | 101504169 A | 8/2009 |
| GB | 2 238 405 A | 5/1991 |
| JP | 6-137639 | 5/1994 |
| JP | 6-180139 | 6/1994 |
| JP | 7-103544 | 4/1995 |
| JP | 8-61741 | 3/1996 |
| JP | 8-178390 | 7/1996 |
| JP | 9-269145 | 10/1997 |
| JP | 2004-178129 | 6/2004 |
| JP | 2006-317075 | 11/2006 |
| JP | 2008-232467 | 10/2008 |
| JP | 2009-2773 | 1/2009 |
| KR | 1993-0010475 | 6/1993 |
| KR | 2008-0048350 | 6/2008 |
| WO | WO 2008/066311 A1 | 6/2008 |

OTHER PUBLICATIONS

Notification of Reasons for Rejection issued by the Korean Patent Office on Apr. 13, 2012, for Korean Patent Application No. 10-2010-0085271, and partial English-language translation thereof.

Notification of Reasons for Reiection for Chinese Application No. 201510535800.8. mailed Mar. 3, 2016.

Extended European Search Report issued by the European Patent Office on Jan. 28, 2015, for European Patent Application No. 10175044-6.

* cited by examiner

AIR CONDITIONING CONTROL SYSTEM AND AIR CONDITIONING CONTROL METHOD

CROSS-REFERENCE TO RELATED ART

This application is based upon and claims the benefit of priority from Japanese Patent Application No. 2010-039157, filed on Feb. 24, 2010; the entire contents of which are incorporated herein by reference.

FIELD

Embodiments described herein relate to an air conditioning control system and an air conditioning control method, which control air conditioning of a building or the like in response to an activity amount of a person present in a room.

BACKGROUND

In an interior space of a building, it is required to ensure an appropriate interior environment by air conditioning control with energy consumption as small as possible. In the event of ensuring an appropriate interior thermal environment, it is important to consider a thermal sensation such as heat and cold sensations felt by a person.

In the case where, in an amount of heat generated by the person (sum of radiant quantity by convection, heat radiation amount by radiating body, amount of heat of vaporization from the person, and amount of heat radiated and stored by respiration), a thermal equilibrium thereof is maintained, then it can be said that human body is in a thermally neutral state, and is in a comfortable state where the person does not feel hot or cold with regard to the thermal sensation. On the contrary, in the case where the thermal equilibrium is disturbed, then human body feels hot or cold.

There is an air conditioning control system that achieves optimization of the air conditioning control by using a predicted mean vote (PMV) as an index of the human thermal sensation, which is based on a thermal equilibrium expression. The air conditioning control system using the PMV receives, as variables affecting the thermal sensation, six variables, which are: an air temperature value; a relative humidity value; a mean radiant temperature value; an air speed value; an activity (internal heat generation amount of human body) value; and a clothes wearing state value. Then, the air conditioning control system calculates a PMV value.

Among the six variables to be inputted, those measurable with accuracy are the air temperature value, the relative humidity value, and the air speed value. Since it is difficult to directly measure the activity value and such a clothing amount value, values set therefor are usually used. However, it is desired to also measure the activity value and the clothing amount value in real time with accuracy.

Accordingly, as a technology for measuring an activity amount of a person who is present in a room, there is a human body activity amount calculation apparatus described in document 1 (JP 8-178390 A).

In the human body activity amount calculation apparatus described in document 1, human body in a room is imaged by imaging means, and an activity amount thereof is calculated based on an image thus obtained. Therefore, the activity amount of the person can be obtained without contacting human body thereof, whereby accurate air conditioning control can be performed.

DETAILED DESCRIPTION

In general, according to one embodiment, an air conditioning control system is connected to a camera device, which is installed in an interior as an inside of a room and an air conditioning control target, and to an air conditioner that performs air conditioning for the interior as the air conditioning target, the air conditioning control system includes: an activity amount calculation unit; a current comfort index value calculation unit; a control parameter calculation unit; and an air conditioner control unit. The activity amount calculation unit acquires and analyzes image information formed by imaging the interior as the air conditioning control target from the camera device, and calculates an activity amount of a person present in the room based on the image information. The current comfort index value calculation unit calculates a current comfort index value of the person present in the room based on the activity amount. The control parameter calculation unit calculates a control parameter regarding an operation of the air conditioner based on the current comfort index value. The air conditioner control unit controls the operation of the air conditioner based on the control parameter.

First Embodiment

<Configuration of Air Conditioning Control System of First Embodiment>

Figure 1:
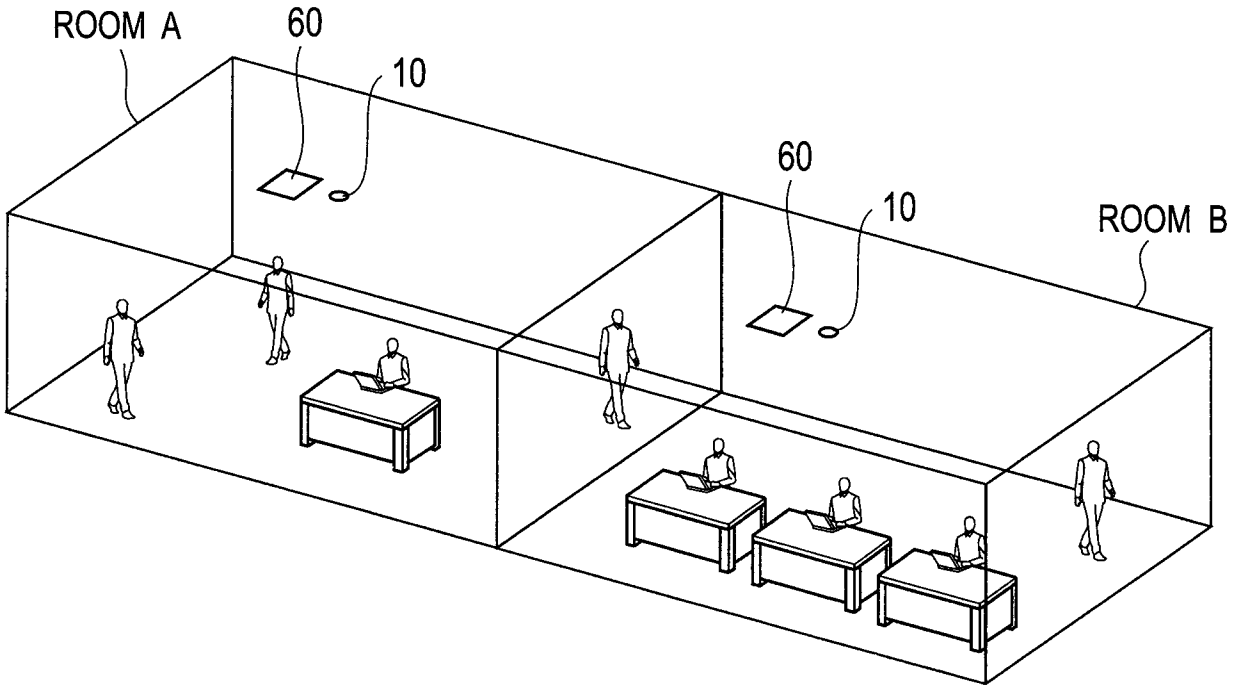
FIG. 1 is an overall view illustrating a configuration of an air conditioning system according to a first embodiment.
Figure 2:
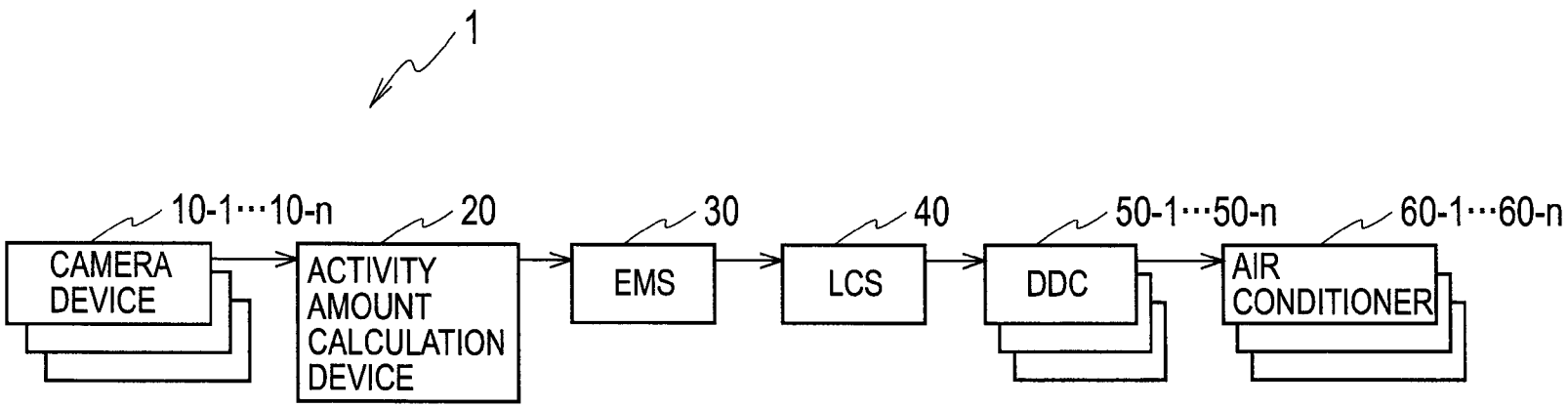
FIG. 2 is a block diagram illustrating the configuration of the air conditioning system according to the first embodiment.
Figure 3:
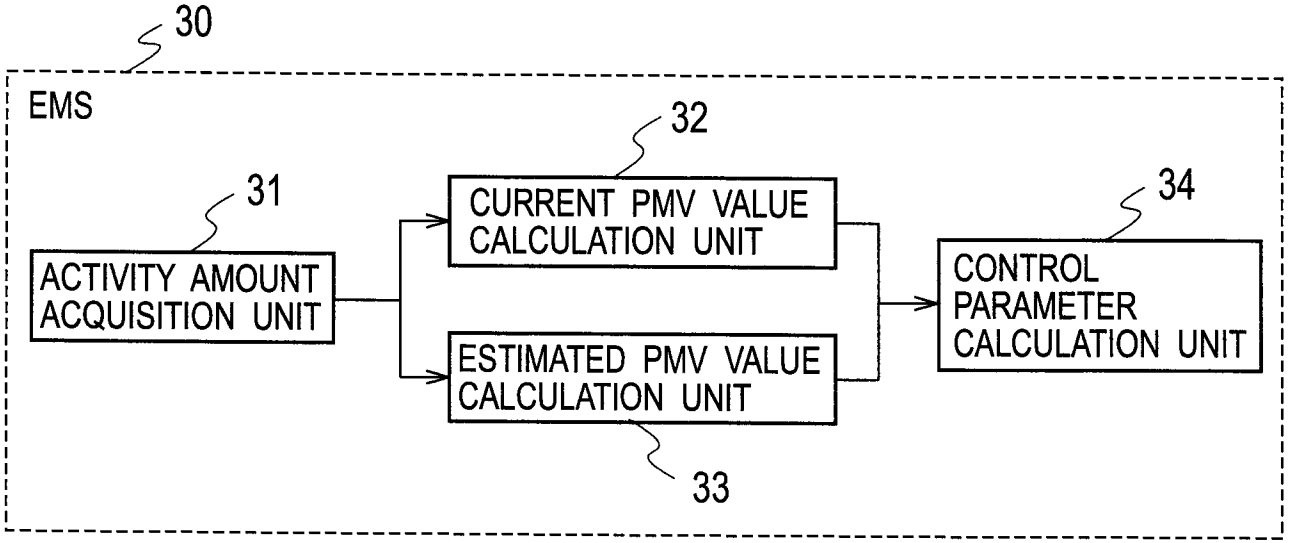
FIG. 3 is a block diagram illustrating a configuration of an energy management system (EMS) of the air conditioning system according to the first embodiment.

A description is made of a configuration of an air conditioning control system 1 of a first embodiment with reference to FIGS. 1 to 3.

As the air conditioning control system 1 of the first embodiment, a description is made of the case where, as illustrated in FIG. 1, one camera device and one air conditioner are installed for each room in a building, and air conditioning control is executed.

As illustrated in FIG. 2, the air conditioning control system 1 of the first embodiment includes: camera devices 10-1 to **10-*n*; an activity amount calculation device 20; an energy management system (EMS) 30; a local control server (LCS) 40; direct digital controllers (DDCs) 50-1 to 50-*n*; and air conditioners 60-1 to 60-*n*. The camera devices 10-1 to 10-*n* are installed for each of interiors as control targets, and image the interiors serving as the control targets. The activity amount calculation device 20 acquires and analyzes video information formed by imaging the interiors by the camera devices 10-1 to 10-*n*, and thereby calculates activity amounts of persons in such rooms as imaging targets. The EMS 30 calculates air conditioning control parameters for each of the rooms based on the activity amounts of the persons present in the rooms, which are calculated by the activity amount calculation device 20. The LCS 40 transmits the air conditioning control parameters, which are calculated by the EMS 30, to the respective direct digital controllers (DDCs) 50-1 to 50-*n* corresponding thereto. The DDCs 50-1 to 50-*n* are air conditioner control units which control operations of the air conditioners of the rooms as the control targets based on the air conditioning control parameters transmitted thereto from the LCS 40. The air conditioners 60-1 to 60-*n* are installed for each of the rooms, and operate by the control of the DDCs 50-1 to 50-*n*** connected thereto.

FIG. 3 illustrates a detailed configuration of the EMS 30. The EMS 30 includes: an activity amount acquisition unit 31; a current PMV value calculation unit 32; an estimated PMV value calculation unit 33; and a control parameter calculation unit 34. The activity amount acquisition unit 31 acquires the activity amounts individually calculated by the activity amount calculation device 20. The current PMV value calculation unit 32 calculates current PMV values as current comfort index values for each of the persons in the rooms from the activity amounts acquired by the activity amount acquisition unit 31. The estimated PMV value calculation unit 33 calculates estimated PMV values as estimated comfort index values of the respective persons present in the rooms after elapse of a predetermined time based on the activity amounts acquired by the activity amount acquisition unit 31. The control parameter calculation unit 34 calculates control parameters regarding the operations of the air conditioners of the respective rooms from the current PMV values of the persons present in the rooms, which are calculated by the current PMV value calculation unit 32, and from the estimated PMV values of the persons present in the rooms, which are calculated by the estimated PMV value calculation unit 33.

<Operations of Air Conditioning Control System According to First Embodiment>

Figure 4:
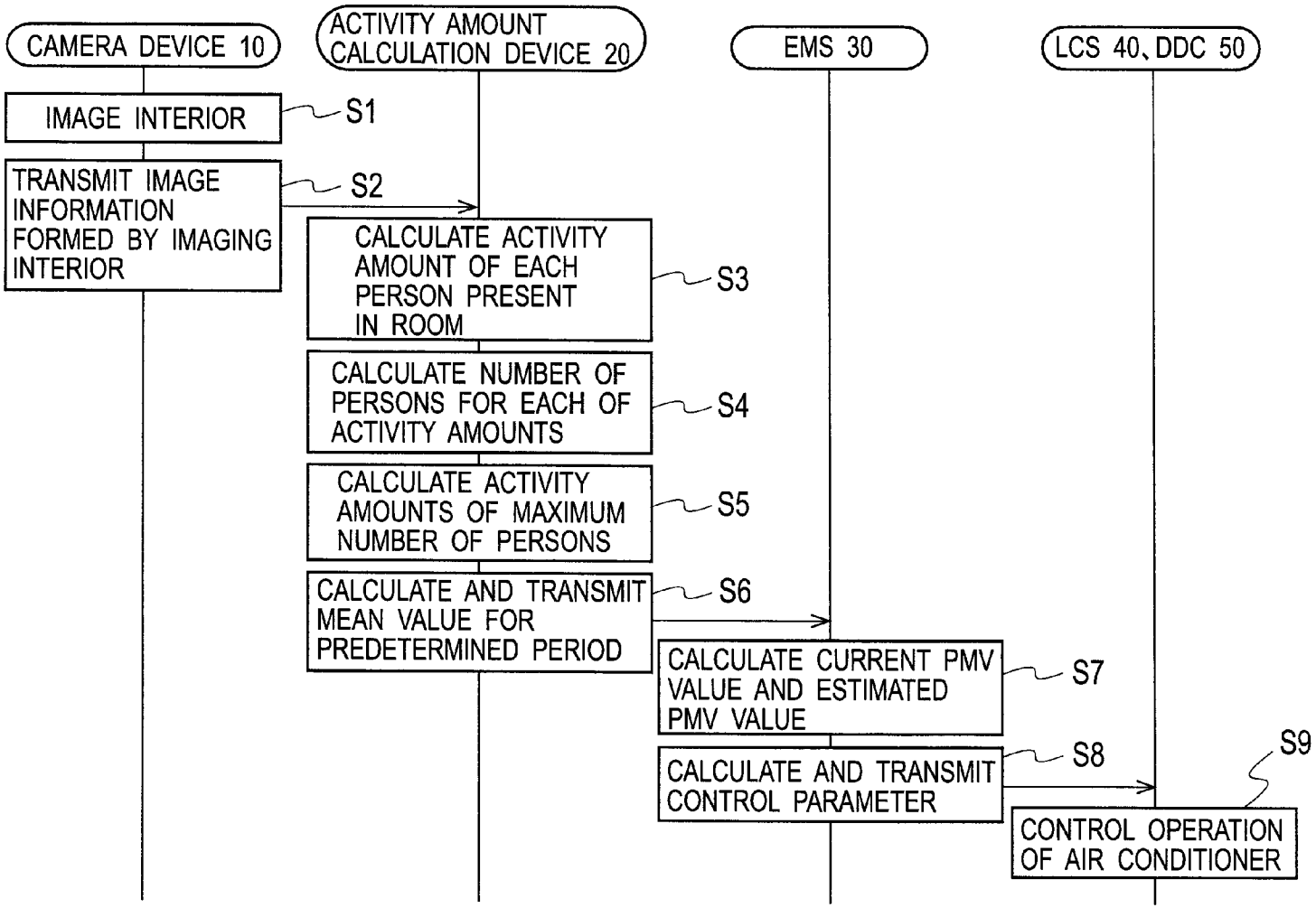
FIG. 4 is a sequence diagram illustrating operations of the air conditioning system according to the first embodiment.

With reference to a sequence diagram of FIG. 4, a description is made of operations of the air conditioning control system 1 according to the first embodiment. First, interior imaging areas are individually imaged by the n pieces of camera devices 10-1 to **10-*n* installed in the respective rooms (S1), and video information formed by imaging the imaging areas is transmitted to the activity amount calculation device 20 (S2**).

In the activity amount calculation device 20, such respective pieces of the video information individually transmitted from the camera devices 10-1 to **10-*n* connected thereto are acquired and analyzed, and based on these pieces of the video information, the activity amounts for each of the persons present in the rooms are calculated on a predetermined time basis (S3**). For such a technology for calculating the activity amounts from image information contained in the video information, there can be used, for example, as described in document 1, a method of calculating a moving speed and the like of each person from a difference among the respective pieces of the image information, which are chronologically acquired.

Next, in the activity amount calculation device 20, the number of persons for each of the activity amounts (met) preset for each of action contents is counted (S4). As the activity amounts (met) for each of the action contents, for example, an activity amount of an operation "sitting" is preset at "1.0 met", an activity amount of an operation "standing" is preset at "1.5 met", an activity amount of an operation "walking" is preset at "2.0 met", and so on. In the case of a state illustrated in FIG. 1, in a room A, count is made such that the number of persons with the activity amount "1.0" (sitting) is one, and that the number of persons with the activity amount "2.0" (walking) is three, and in a room B, count is made such that the number of persons with the activity amount "1.0" (sitting) is three, and that the number of persons with the activity amount "2.0" (walking) is one.

Next, the activity amount of the maximum number of persons for each of the rooms is extracted from the counted number of persons for each of the activity amounts (S5). Here, with regard to the room A, the activity amount "2.0" (walking: three persons) in which the number of persons is the maximum is extracted, and with regard to the room B, the activity amount "1.0" (sitting: three persons) in which the number of persons is the maximum is extracted.

Next, the activity amount of the maximum number of persons for each of the rooms, which is extracted from the image information as described above, is calculated. The activity amount of the maximum number of persons, which is calculated by the activity amount calculation device 20, is transmitted as the activity amount of each of the rooms to the EMS 30 (S6).

In the EMS 30, the activity amount of each of the rooms, which is transmitted from the activity amount calculation device 20, is acquired by the activity amount acquisition unit 31, and the current PMV value of each of the rooms is calculated based on the activity amount concerned, on temperature, humidity, air speed, radiant temperature of each of the rooms, which are acquired separately, and on a clothing amount that is also acquired separately.

Moreover, an estimated PMV value of each of the rooms after the elapse of the predetermined time is also calculated based on the activity amount of each of the rooms, which is acquired by the activity amount acquisition unit 31, on estimated temperature, estimated humidity, estimated air speed, estimated radiant temperature of each of the rooms after the elapse of the predetermined time, which are acquired separately, and an estimated clothing amount of the elapse of the predetermined time, which is also acquired separately (S7). This estimated PMV value is a value calculated, for example, in consideration of persons present in the room and an interior environment, which are preset for each of time ranges in one day. When it is estimated: "it will soon be a time period for lunch, the persons will go out of each of the rooms, and the activity amount of each of the rooms will be reduced", the estimated PMV value is calculated so as to be lower than the current PMV value. When it is estimated: "the outdoor air temperature will rise from now on, and the radiant temperature will also rise", the estimated PMV value is calculated so as to be higher than the current PMV value.

Then, based on the current PMV value and the estimated PMV value, which are calculated as described above, the control parameter regarding the operations of the air conditioner of each of the rooms is calculated by the control parameter calculation unit 34 (S8). For example, in the case where it is estimated: "it will soon be the time period for lunch, and the persons will go out of the room" and the estimated PMV value is calculated so as to be lower than the current PMV value when the current PMV value becomes higher and it is considered to intensify the air conditioning, the control parameter is calculated so as to suppress an intensification degree of the air conditioning.

At this time, within a preset comfortable range, the control parameter is set so that energy consumption, $CO_2$ emission, or running cost can be minimum, whereby it becomes possible to execute more efficient air conditioning control.

Then, the control parameters regarding the operations of the air conditioners of the respective rooms, which are calculated by the control parameter calculation unit 34, are transmitted by the LCS 40 to the DDCs 50-1 to **50-*n* corresponding thereto, and the operations of the air conditioners 60-1 to 60-*n* installed in the respective rooms are controlled based on the control parameters corresponding to the DDCs 50-1 to 50-*n* connected thereto (S9**).

In accordance with the air conditioning system of the first embodiment, which is as described above, the highly accurate activity amounts of the persons in the rooms are calculated by analyzing the image information, and based on circumstances of the current and future interior environments, which are calculated based on the activity amounts concerned, the efficient air conditioning can be executed.

Other Embodiments

Moreover, in the control parameter calculation unit 34 of the EMS 30 of the air conditioning control system 1 according to the above-described first embodiment, the control parameter may be calculated in consideration of not only the current PMV value and estimated PMV value of the room as the imaging target but also a current PMV value and estimated PMV value of the room or an area, which is adjacent thereto, at the time when the control parameters are calculated.

Circumstances of the persons present in the adjacent room or area are also considered as described above, whereby differences in control parameter among the adjacent rooms or areas can be reduced, and more efficient air conditioning control can be performed in the whole of the building.

For example, when the activity amount of the person present in the room A is 1.0 and the current PMV value therein is 0.1, and the activity amount of the person present in the room B adjacent to the room A is 2.0 and the current PMV value or the estimated PMV value therein is 1.0, the air conditioning control is set to be somewhat intense in consideration of the activity amount and PMV value of the room B at the time of calculating the control parameter of the air conditioner of the room A, whereby the efficient air conditioning control can be performed.

Moreover, at the time when the control parameter is calculated by the control parameter calculation unit 34, the control parameter is calculated based on the current PMV value of the room as the imaging target. In such a way, the efficient air conditioning can be executed based on the circumstances of the current interior environment.

Figure 5:
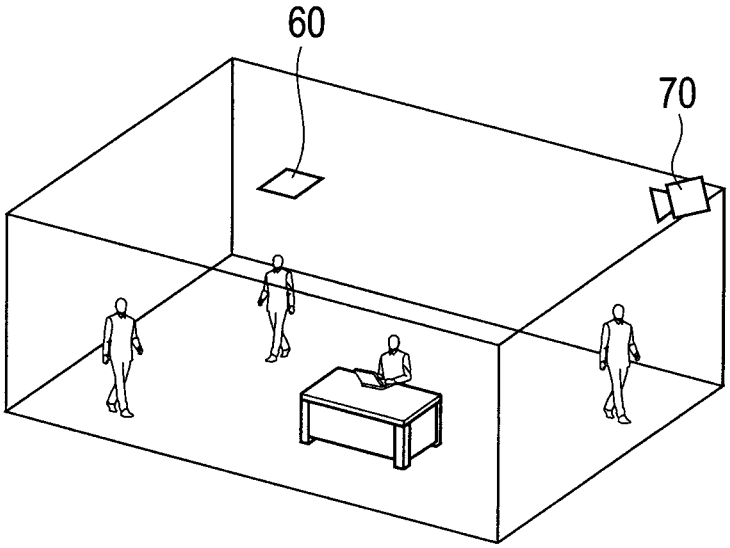
FIG. 5 is an overall view illustrating a configuration of an air conditioning system according to another embodiment.

Moreover, each of the camera devices 10-1 to **10-*n* for use in the air conditioning control system 1 of the above-described first embodiment may be installed on a center portion of a ceiling of each room as illustrated in FIG. 1 in a manner of looking down the interior. Alternatively, as illustrated in FIG. 5, a surveillance camera 70 to be used as each of the camera devices 10-1 to 10-*n* may be installed on an end portion of the ceiling in a manner of looking down the interior from a diagonal upper portion. Alternatively, the persons present in each room may be imaged by using a Web camera built in a personal computer. The surveillance camera is used as each of the camera devices 10-1 to 10-*n* of the air conditioning control system 1** according to this embodiment, whereby the camera device concerned can be used for calculating the activity amounts for the air conditioning control during a daytime while the air conditioning control is necessary, and the camera device concerned can be used as the surveillance camera during a nighttime while the air conditioning control is unnecessary.

Moreover, in the air conditioning control system 1 of the above-described first embodiment, the description has been made of the case where the activity amounts of a larger number of persons are extracted and used (majority decision) at the time of calculating the activity amounts in each room by the activity amount calculation device 20. However, without being limited to this, static values such as a mean value, sum value, and variance value of the activity amounts of a larger number of the persons or the activity amounts of all of the persons present in the room may be calculated, and may be used as the activity amount in each of the rooms, or alternatively, static values such as a mean value, sum value, and variance value of these static values for a predetermined period may be calculated and used as the activity amount in each of the rooms.

Moreover, a time interval at which the calculation processing for the activity amounts is performed by the activity amount calculation device 20 may be fixed to a constant interval or may be varied. The time interval at which the calculation processing for the activity amounts is varied. In such a way, during a time range while variations of the number of users of a station or the like, such as a time range while a commuter rush begins therein, are large, the activity amounts are calculated at a fine time interval, whereby suitable air conditioning control can be performed. Moreover, during a time range while the number of users is stable, the activity amounts are calculated at a rough time interval, whereby a load regarding the air conditioning control can be reduced.

Figure 6:
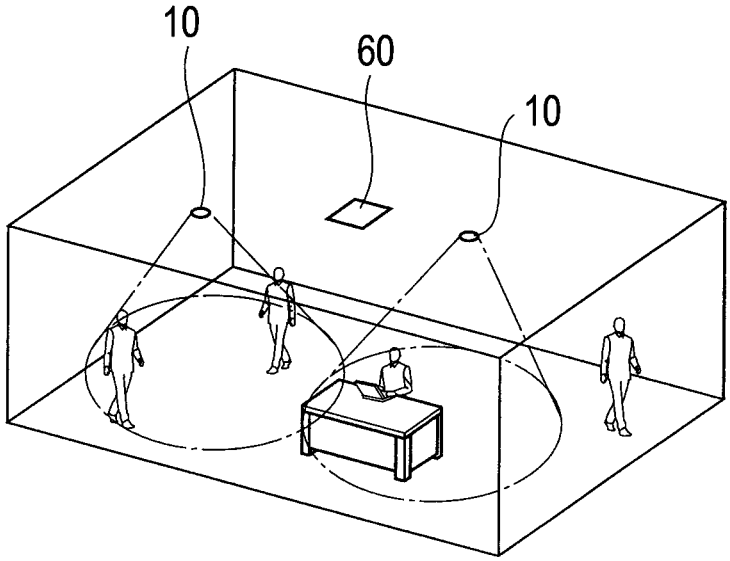
FIG. 6 is an overall view illustrating a configuration of an air conditioning system according to another embodiment.

Moreover, in the above-described first embodiment, the description has been made of the case where one camera device and one air conditioner are installed for one room or area. However, without being limited to this, a plurality of camera devices may be installed for one room as illustrated in FIG. 6. In this case, the plurality of camera devices may be installed in either manner that imaging areas of the plurality of camera devices overlap each other or that the imaging areas concerned do not overlap each other.

When the plurality of camera devices are installed for one air conditioner of one room, the activity amount calculation device 20 may integrate plural pieces of the image information obtained by imaging the interior by the plurality of camera devices, create one panorama image regarding the whole of the room concerned, and calculate the activity amount in the room concerned by using this panorama image. Alternatively, the activity amount calculation device 20 may integrate plural pieces of information on the activity amounts individually calculated from plural pieces of the image information obtained by imaging the interior by the respective camera devices, and define the integrated pieces of information as the activity amount in the room concerned.

Moreover, with regard to the plural pieces of image information obtained by such imaging by the plurality of camera devices, the respective pieces of image information concerned may be analyzed as two-dimensional images by performing monocular image processing therefor. Alternatively, the two pieces of image information may be analyzed as a three-dimensional image by performing binocular image processing such as stereoscopic image processing therefor.

In the case of analyzing the image information by the monocular image processing, the activity amount calculation device 20 can detect motions of the persons present in the room on the image information by using an optical flow, using a background difference method, and so on, and can thereby calculate the activity amount.

Moreover, in the case of analyzing the image information by the stereoscopic image processing, the activity amount calculation device 20 detects attitudes and motions of the persons present in the room in a three-dimensional space from the image information obtained by imaging the interior by the camera devices installed at two different positions. In such a way, the activity amount calculation device 20 determines the motions such as "sitting", "standing" and "walking", and can thereby calculate the activity amount. Here, when each of the motions is determined to be "walking", a more detailed activity amount can be calculated by calculating a walking speed of the person concerned from a moving amount thereof in the three-dimensional space.

Figure 7:
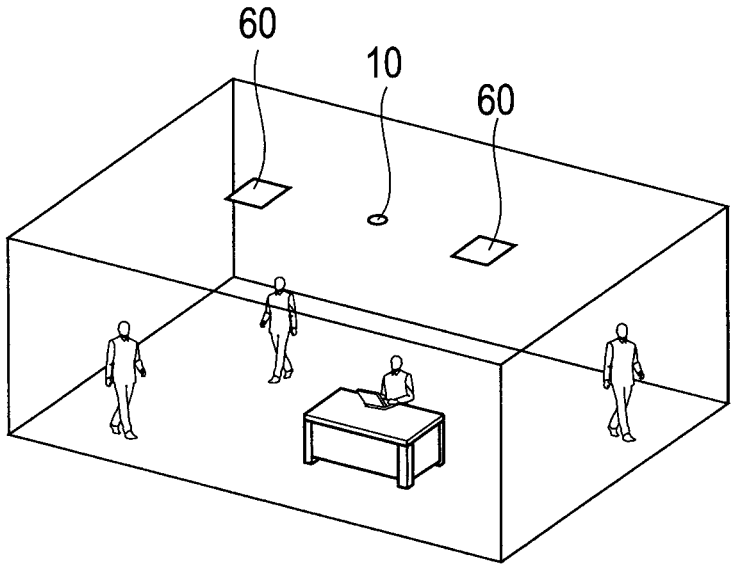
FIG. 7 is an overall view illustrating a configuration of an air conditioning system according to another embodiment.

Moreover, as illustrated in FIG. 7, a plurality of air conditioners may be installed for one room or area. In this case, the activity amount calculation device 20 may divide the image information of the whole of the room concerned, which is obtained by such imaging by a super-wide angle camera such as a fish-eye camera, into pieces of the image information in response to control target areas of the respective air conditioners, and may use the divided pieces of image information for calculation processing of activity amounts for each of the areas. Moreover, the activity amount calculation device 20 may calculate the activity amounts of the respective persons present in the room from the image information of the whole of the room concerned, and from the calculated activity amounts of the respective persons present in the room, may calculate the activity amounts for each of the areas based on positional information of the persons present in the room.

Furthermore, by using these technologies, a plurality of camera devices and a plurality of air conditions may be installed for one room or area, and control parameters for the plurality of air conditioners may be calculated by using image information obtained by such imaging by the plurality of camera devices.

Furthermore, the activity amount calculation device 20 may analyze the image information to calculate the activity amount of each of the persons present in the room, and may thereafter calculate the activity amounts of the persons present in the room based on a result of calculating the activity amount concerned. Alternatively, the activity amount calculation device 20 may calculate the activity amounts of the persons present in the room by analyzing the image information and detecting the motions of the persons from the whole of the room.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An air conditioning control system for controlling one or more air conditioners which perform air conditioning of an area as an air conditioning control target, the air conditioning control system comprising:

an activity amount calculation unit that analyzes image information sent from one or more camera devices that capture images in the area as the image information, and calculates a first activity amount based on the image information;

a comfort index value calculation unit that calculates a comfort index value in the area at a current time based on the first activity amount;

a control parameter calculation unit that calculates a control parameter regarding an operation of the air conditioners based on the comfort index value in the area and a comfort index value of an adjacent area adjacent to the area without a wall; and an air conditioner control unit that controls the operation of the air conditioners based on the control parameter, wherein the activity amount calculation unit analyzes the image information to thereby calculate second activity amounts of respective persons in the area, and sets, as the first activity amount, an activity amount in the second activity amounts that corresponds to a maximum number of persons among the persons.

2. The air conditioning control system according to claim 1, further comprising:

an estimated comfort index value calculation unit that calculates an estimated comfort index value in the area after elapse of a predetermined time based on the first activity amount, wherein the control parameter calculation unit calculates the control parameter regarding the operation of the air conditioners based on the comfort index value and the estimated comfort index value.

3. The air conditioning control system according to claim 1, wherein the activity amount calculation unit analyzes the image information to thereby calculate second activity amounts of respective persons in the area, and calculates the first activity amount based on the second activity amounts of the respective parsons.

4. The air conditioning control system according to claim 1, wherein the activity amount calculation unit analyzes the image information to thereby calculate second activity amounts of respective persons in the area for at least one of a constant or variable predetermined period, and sets, as the first activity amount, a static value of the second activity amounts of the respective persons.

5. The air conditioning control system according to claim 1, wherein two or more of the camera devices are installed in the area, and the activity amount calculation unit creates a first piece of integrated image information from a plurality of pieces of the image information formed by imaging in the area by the camera devices and thereby calculates the first activity amount by using the first piece of integrated image information, or calculates second activity amounts of respective persons from the pieces of image information and thereby calculates the first activity amount by integrating the second activity amounts of the respective persons.

6. The air conditioning control system according to claim 1, wherein two of more of the air conditioners are installed in the area, and the activity amount calculation unit divides the image information into a plurality of pieces of the image information corresponding to control target areas of respective air conditioners in the area and thereby calculates an activity amount for each of the control target areas, or calculates second activity amounts of respective persons from the image information and thereby calculates the activity amount for each of the control target areas based on positional information of the respective persons, and the control parameter calculation unit calculates a control parameter corresponding to each of the air conditioners from the comfort index values, the comfort index values being individually calculated from the activity amounts for the respective control target areas.

7. The air conditioning control system according to claim 1, wherein the activity amount calculation unit detects motions of the persons by analyzing the image information and thereby calculates the first activity amount.

8. An air conditioning control method for an air conditioning control system to control one or more air conditioners which perform air conditioning of an area as an air conditioning control target, the air conditioning control method comprising:

analyzing image information sent from one or more camera devices that capture images in the area as the image information, and calculating a first activity amount based on the image information;

calculating a comfort index value in the area at a current time based on the first activity amount;

calculating a control parameter regarding an operation of the air conditioners based on the comfort index value in the area and a comfort index value of an adjacent area adjacent to the area without a wall; and controlling the operation of the air conditioner based on the control parameter, wherein the analyzing of the image information and the calculating of the first activity amount based on the image information includes: analyzing the image information to thereby calculate second activity amounts of respective persons in the area, and setting, as the first activity amount, an activity amount in the second activity amounts that corresponds to a maximum number of persons among the persons.

* * * * *